United States Patent [19]

Rüter

[11] Patent Number: 4,566,245

[45] Date of Patent: Jan. 28, 1986

[54] COLLAPSIBLE CONSTRUCTION ASSEMBLY

[75] Inventor: Ewald Rüter, Dortmund, Fed. Rep. of Germany

[73] Assignee: E. Rüter GmbH, Dortmund, Fed. Rep. of Germany

[21] Appl. No.: 505,257

[22] Filed: Jun. 17, 1983

[30] Foreign Application Priority Data

Jun. 18, 1982 [DE] Fed. Rep. of Germany ..... 3222811

[51] Int. Cl.[4] ..... E04H 12/18

[52] U.S. Cl. ..... 52/645; 52/646; 182/179; 403/172; 403/218

[58] Field of Search ..... 52/645, 646, 648, 662, 52/580, 635, 650, 652, 239; 403/172, 174, 176, 178, 218; 182/179

[56] References Cited

U.S. PATENT DOCUMENTS

| | | | |
|---|---|---|---|
| 1,773,030 | 8/1930 | Connely | 52/648 |
| 3,168,793 | 2/1965 | Gibson | 52/648 |
| 3,282,006 | 11/1966 | Halsey | 52/239 |
| 3,507,526 | 4/1970 | Packman et al. | 403/174 |
| 3,877,191 | 4/1975 | Munsey | 52/239 |
| 3,971,182 | 7/1976 | Donahue | 52/239 |
| 4,027,449 | 6/1977 | Cilveti | 52/648 |
| 4,039,264 | 8/1977 | Sharp | 182/179 |
| 4,109,838 | 8/1978 | Hage | 52/239 |
| 4,147,321 | 3/1979 | Gostling | 52/645 |
| 4,405,254 | 9/1983 | Tooley | 182/179 |
| 4,424,654 | 1/1984 | Anderson et al. | 52/239 |
| 4,439,052 | 3/1984 | Wallther | 182/179 |

FOREIGN PATENT DOCUMENTS

| | | | |
|---|---|---|---|
| 754701 | 2/1970 | Belgium . | |
| 1900901 | 9/1970 | Fed. Rep. of Germany . | |
| 1778357 | 5/1971 | Fed. Rep. of Germany . | |
| 2625455 | 12/1977 | Fed. Rep. of Germany . | |
| 2625465 | 12/1977 | Fed. Rep. of Germany | 52/648 |
| 2067405 | 8/1971 | France . | |
| 570886 | 12/1957 | Italy | 52/64 |
| 610666 | 10/1960 | Italy | 52/646 |
| 347329 | 8/1960 | Switzerland | 52/239 |
| 2079396 | 1/1982 | United Kingdom . | |

*Primary Examiner*—John E. Murtagh
*Assistant Examiner*—Andrew Joseph Rudy
*Attorney, Agent, or Firm*—Karl F. Ross; Herbert Dubno

[57] ABSTRACT

A construction assembly for making a collapsible structure has a post extending along and defining an upright post axis and having one end formed with an axially centered threaded bore open in one axial direction, normally upward. A first plate fixed on the post offset in the opposite axial direction, normally downward, from the one end extends generally perpendicular to the axis and is formed with at least one vertically throughgoing cutout offset from the post axis. A frame has a first fitting formed with a projection extending in the opposite direction through the hole and formed on the side of the first plate directed in this opposite direction with a passage that is throughgoing parallel to the first plate, and a second fitting at the one post end and formed with a projection extending in the one direction. A locking member engaged through the passage bears in the one direction on the first plate. A second plate extending generally perpendicular to the post axis is formed at the axis with a throughgoing bore and offset from the axis with a vertically throughgoing cutout through which extends the projection of the second fitting. A bolt threaded in the bore of the post passes through the bore of the second plate and has a head bearing in the opposite direction on the second plate. Thus the bolt presses the second plate down on the second fitting to lock the frame to the post.

6 Claims, 3 Drawing Figures

COLLAPSIBLE CONSTRUCTION ASSEMBLY

FIELD OF THE INVENTION

The present invention relates to a collapsible construction assembly. More particularly this invention concerns such an assembly used to make reusable structures such as displays, buildings, and the like.

BACKGROUND OF THE INVENTION

A collapsible construction assembly is known from my German patent document No. 2,625,455 which refers to German Pat. Nos. 1,778,357 and 1,900,901. This assembly has a normally upright post provided with vertically spaced horizontal plates each formed with a plurality of notches opening outward relative to the post axis from the sides of the post. Upper and lower frame traverses interconnected by a vertical strut have at their ends fittings that can engage in these notches, which are formed with a widened central region. The fittings are complementarily formed, so that the traverses can be dropped into the notches to assume a position wherein relative horizontal movement of the frame traverses and post is impossible. The fittings are also formed with passages that are throughgoing parallel to the respective plates, the passage of the upper traverse being above the upper plate and the passage of the lower traverse being below the lower plate. Wedges or keys can be fitted through these upper and lower passages to bear respectively downward and upward on the respective plates, thereby locking the assembly snugly together.

Such an arrangement can be used to make a structure in which the spacing between plates is the floor-to-ceiling distance, so that appropriate floor and ceiling members can be connected to the lower and upper traverses. The number of plates can be increased on a single post to increase the number of stories of the collapsible structure formed thereby.

Although such an assembly is extremely rigid, it is relatively difficult to put together. The fittings must be meticulously positioned and then the respective wedges inserted in each of them, an operation that normally requires several workers. When the post has four sides and four frames are to be secured to it, one must therefore insert eight keys or wedges.

OBJECTS OF THE INVENTION

It is therefore an object of the present invention to provide an improved collapsible construction assembly.

Another object is the provision of such a collapsible construction assembly which overcomes the above-given disadvantages, that is which is relatively easy to put together and take apart.

SUMMARY OF THE INVENTION

A construction assembly for making a collapsible structure according to the invention has a post extending along and defining an upright post axis and having one end formed with an axially centered threaded bore open in one axial direction, normally upward. A first plate fixed on the post offset in the opposite axial direction, normally downward, from the one end extends generally perpendicular to the axis and is formed with at least one vertically throughgoing hole offset from the post axis. A frame has a first fitting formed with a projection extending in the opposite direction through the hole and formed on the side of the first plate directed in this opposite direction with a passage that is throughgoing parallel to the first plate, and a second fitting at the one post end and formed with a projection extending in the one direction. A locking member engaged through the passage bears in the one direction on the first plate. A second plate extending generally perpendicular to the post axis is formed at the axis with a throughgoing bore and offset from the axis with a vertically throughgoing hole through which extends the projection of the second fitting. A bolt threaded in the bore of the post passes through the bore of the second plate and has a head bearing in the opposite direction on the second plate. Thus the bolt presses the second plate down on the second fitting to lock the frame to the post.

According to another feature of this invention the post is tubular and of polygonal section with a plurality of flat sides and the plates each are formed with one such hole for each such side. Thus a number of frames equal to the number of sides can be clamped between the plates.

With such an arrangement the lower fittings can be dropped through the lower fixed plate and secured in place with the respective locking members, which normally are wedges. Once all of the frames are thus positioned, the upper plate is bolted down in place, securing the upper ends securely in place with a single operation. This reduces the number of locking elements by half, and similarly reduces the steps necessary to put the device together.

According to another feature of this invention the upwardly extending projections of the upper fittings can also be formed with transversely throughgoing holes for receiving locking members. Thus when necessary a third fastening can be provided.

In accordance with another feature of this invention the tubular post is provided at the one end with a transverse web forming the threaded bore. This can be accomplished simply by welding a nut to the web. In addition the post is formed at the one end with at least one notch open axially in the one direction and the second fitting is provided with a bolt extending through the notch and is provided inside the post with a head larger than the notch. In this arrangement the web is formed with at least one axially throughgoing opening aligned with the notch and receiving the bolt head. This ensures that the system will hold stably together even before the upper plate is positioned, and provides another level of protection for the system.

The bolt according to the invention is sufficiently long that it can be screwed out of the threaded bore in the one direction sufficiently to allow the second plate to be lifted clear of the projection of the second fitting. Thus this second plate remains attached to the post and cannot be lost.

DESCRIPTION OF THE DRAWING

The above and other features and advantages will become more readily apparent from the following, reference being made to the accompanying drawing in which.

SPECIFIC DESCRIPTION

Figure 1:
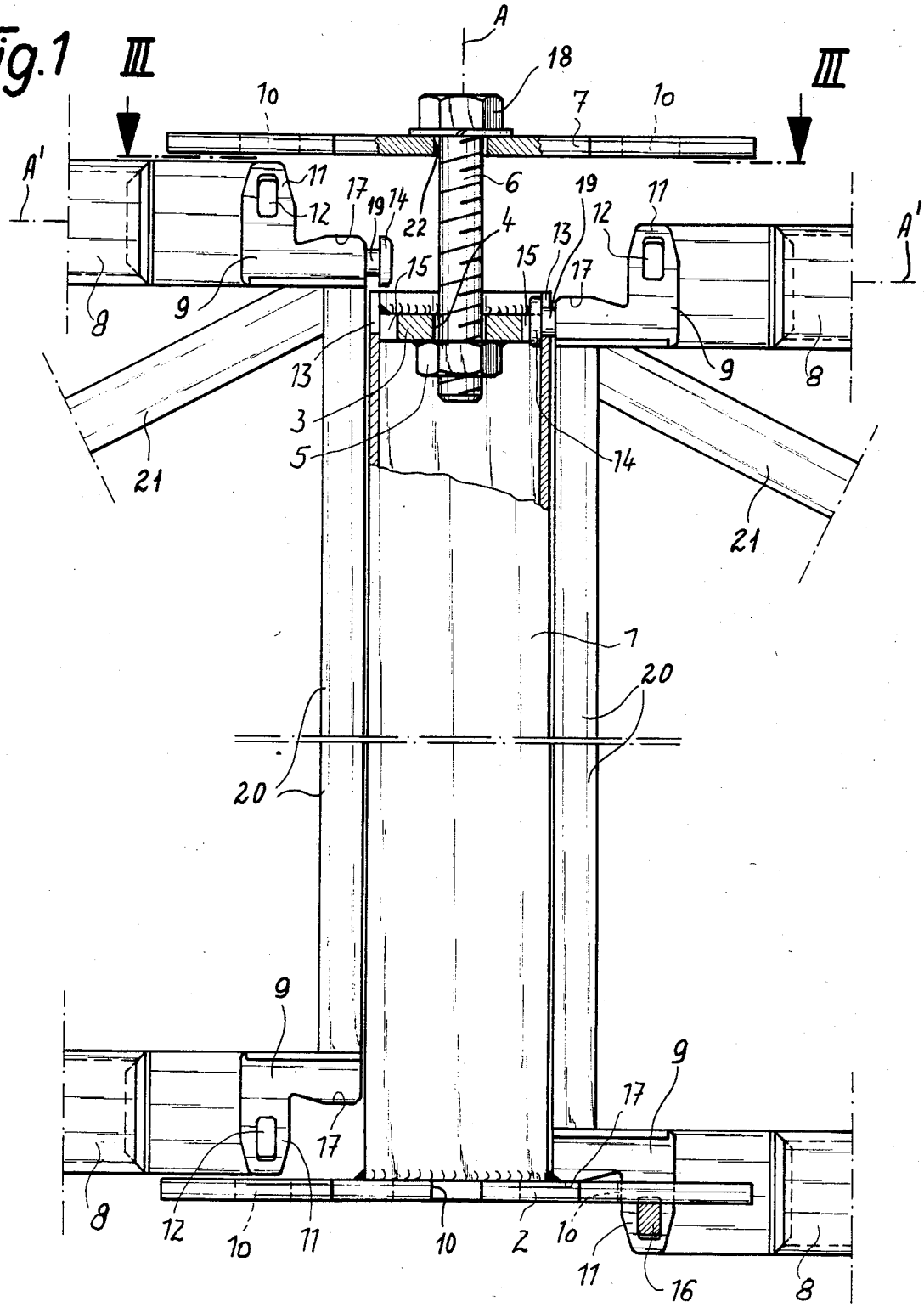
FIG. 1 is a partly sectional side view of the assembly according to this invention in partly assembled condition.

As seen in FIG. 1 a post 1 according to this invention is a square-section metal extrusion extending along and defining an axis A. Welded to its lower end is an octagonal plate 2 perpendicular to the axis A and welded inside its upper end is a transverse web or another plate 3 formed with an axially centered bore 4. A nut 5 whose threaded bore is also centered on the axis A is welded to the underside of the plate 3.

A bolt 6 is threaded into the nut 5 and passes through a bore 22 formed in another plate 7 substantially identical to the plate 2, with the bolt head 18 bearing axially toward the post 1 on the plate 7. The plates 2 and 7 serve to secure transverse frame elements 8 centered on axes A′ perpendicular to the axis A to the ends of the post 1. To this end the elements 8 are provided on their ends with fittings 9 having tabs 11 projecting transversely to the respective axis A′ and parallel to the axis A, with the upper tab 11 projecting upward and the lower tab 11 projecting downward. Vertical struts 20 interconnect the fittings 9 of the upper and lower elements 8, and a diagonal strut 21 is provided to form a rigid frame 8, 9, 20, 21.

The tabs 11 are each formed with a throughgoing hole or passage 12 extending perpendicular to the plane of the axis A and the respective axis A′, it being understood that as many such elements 8 can be secured to the post 1 as the post 1 has sides, here four. The plates 2 and 7 are in turn formed with respective keyhole-shaped cutouts 10 that are throughgoing parallel to the axis A and that complementarily receive the fittings 9 with the tabs 11. The lower elements 8 are secured to the plate 2 by fitting the tabs 11 through these cutouts 10 and then driving wedges 16 through the holes 12. To minimize bending stresses in the plate 2 the fittings 9 are formed at their outermost ends with bumps 17 that engage in the direction of axis A against the plate 2 immediately adjacent the post 1.

Figure 2:
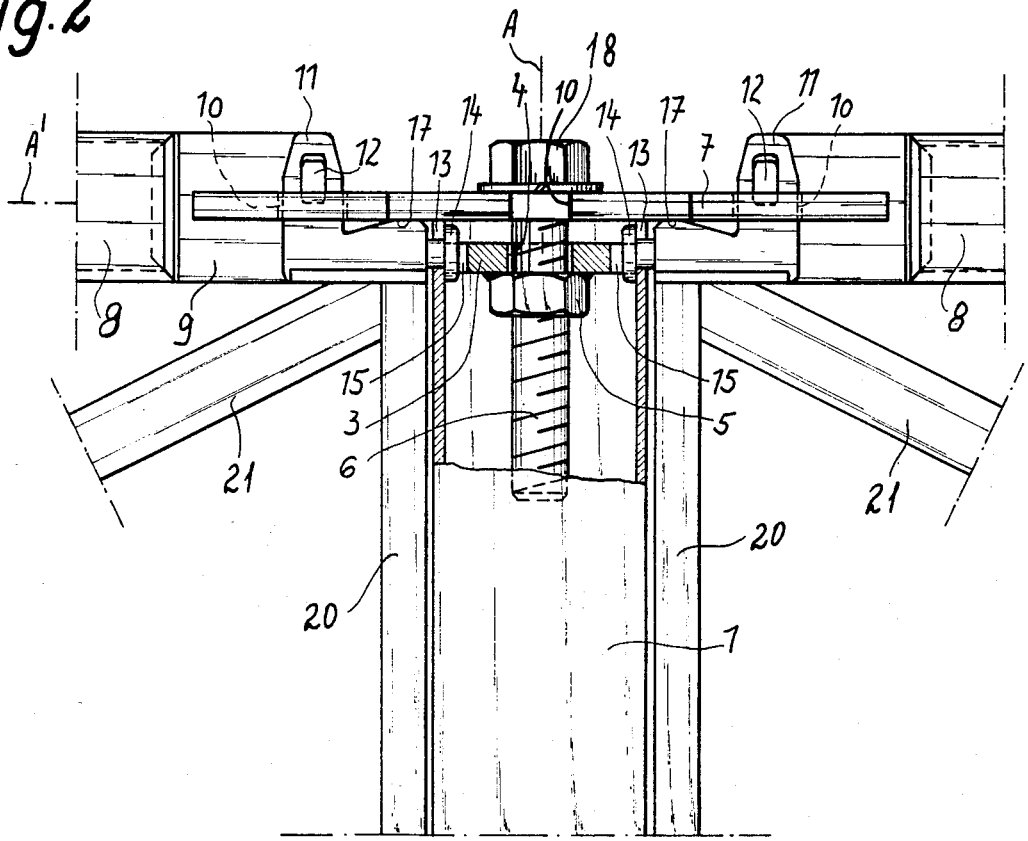
FIG. 2 is a view corresponding to a portion of FIG. 1, but in the fully assembled condition.
Figure 3:
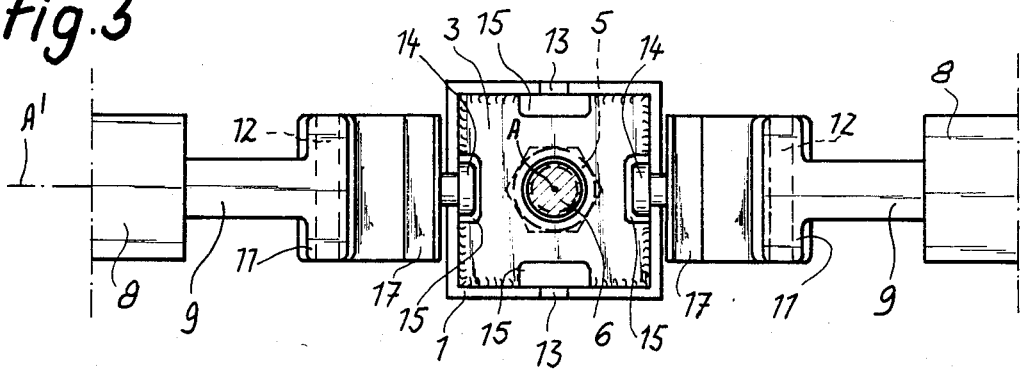
FIG. 3 is a section taken along line III—III of FIG. 1.

The fittings 9 of the upper elements 8 are provided with studs 19 having enlarged heads 14 and centered on the respective axes A′. The upper end of the post 1 is formed on each side with an axially upwardly open notch 13 complementary to the respective stud 19 but of smaller section than the respective head 14, and the plate 3 is formed with cutouts 15 that can accommodate these heads 14. Thus, as can be seen on the right in FIG. 1 and on both sides in FIG. 2, the upper elements 8 can be seated in these notches 13 which will impede any relative movement of the post 1 and element 8 except in one direction, here upward, along the axis A.

This assembly is therefore put together by the simple expedient of dropping the tabs 11 of the lower element 8 down through the cutout 10 of the lower plate 2 while simultaneously fitting the stud 19 of the upper element 8 into the respective notch 13, these actions being simultaneous since the strut 20 joins the two superposed elements 8 together. In this position the assembly is perfectly stable.

As each such frame 8, 9, 20, 21 is fitted in place the respective wedge 16 is put in to hold it there. Finally, when all the frames 8, 9, 20, 21 are thus secured the bolt 6 is screwed down so the tabs 11 of the upper element 8 move up through the respective cutout. The bumps 17 come to bear tightly and oppositely on the plates 2 and 7, so that the assembly is snugly locked together.

Disassembly is the same procedure with its steps in the opposite order.

In this arrangement, therefore, the frames 8, 9, 20, 21 can be fitted by one person to the post 1. Each frame 8, 20, and 21 can be provisionally and safely secured in place by a single wedge 16, and once all the frames for a single post 1 are in place, the single bolt 6 is screwed down to lock the arrangement together into a very rigid unit. Thus only one separable part—the wedge 16—is needed for each frame 8, 20, and 21 at each post, yet when the bolt 6 is screwed down each such frame is held in place by two separate mechanical means, for maximum safety. Only one person is needed to put together the assembly according to the invention, which holds together quite well during such assembly.

I claim:

1. A construction assembly for making a collapsible structure, the assembly comprising:

an elongated post extending along and defining a normally upright post axis and having an upper end and a lower end, the upper end being formed with a transverse web having an axially centered threaded bore open in an upward axial direction away from the lower post end and with an axially upwardly open notch;

a lower planar plate fixed at the lower end of the post, extending generally perpendicular to the post axis, and formed with at least one axially throughgoing lower cutout offset from the post axis and radially offset relative thereto from the post;

a frame having a lower fitting formed with an axial projection extending axially down through the lower cutout and formed directly underneath the lower plate with a passage that is throughgoing parallel to the lower plate, and an upper fitting at the upper post end and formed with an upper projection extending axially upward away from the lower post end and provided with a stud extending through the notch and having inside the post a stud head larger than the notch, whereby the stud secures the upper fitting on the post against downward or horizontal movement relative thereto;

a locking member engaged through the passage and bearing axially upward toward the upper end on the lower plate;

an upper planar plate extending generally perpendicular to the post axis, formed at the axis with a throughgoing bore and offset from the axis with an axially throughgoing cutout through which extends the upper projection of the upper fitting; and a bolt threaded in the bore of the web, passing through the bore of the upper plate, and having a bolt head bearing axially downward on the upper plate, whereby the bolt head presses the upper plate down on the upper fitting to lock the frame to the post.

2. The collapsible construction assembly defined in claim 1 wherein the web is formed with at least one axially throughgoing opening aligned with the notch and receiving the stud head.

3. The collapsible construction assembly defined in claim 1 wherein the bolt is sufficiently long that it can be screwed out of the threaded bore axially away from the post sufficiently to allow the upper plate to be lifted clear of the upper projection of the upper fitting.

4. The collapsible construction assembly defined in claim 1 wherein the post is tubular and of polygonal section with a plurality of flat sides, the upper and lower plates each being formed with one respective such upper and lower cutout for each side, whereby a number of frames equal to the number of sides can be clamped between the upper and lower plates.

5. The collapsible construction assembly defined in claim 1 wherein both fittings are substantially identical but oppositely oriented on the frame.

6. The collapsible construction assembly defined in claim 1 wherein the fittings are fixed on the frame and nondisplaceable relative to each other.

* * * * *